US011543217B2

(12) United States Patent
Rushing

(10) Patent No.: US 11,543,217 B2
(45) Date of Patent: Jan. 3, 2023

(54) SHOOTING STALLS AND RANGES

(71) Applicant: RATAS Investments, Inc., Spring, TX (US)

(72) Inventor: Brian K. Rushing, Houston, TX (US)

(73) Assignee: RATAS INVESTMENTS, INC., Spring, TX (US)

( * ) Notice: Subject to any disclaimer, the term of this patent is extended or adjusted under 35 U.S.C. 154(b) by 322 days.

(21) Appl. No.: 16/789,391

(22) Filed: Feb. 12, 2020

(65) Prior Publication Data

US 2020/0256653 A1 Aug. 13, 2020

Related U.S. Application Data

(60) Provisional application No. 62/805,022, filed on Feb. 13, 2019.

(51) Int. Cl.
*F41J 11/00* (2009.01)
*E04B 2/72* (2006.01)

(52) U.S. Cl.
CPC ..... *F41J 11/00* (2013.01); *E04B 2/72* (2013.01)

(58) Field of Classification Search
CPC ..... F41J 11/00; F41J 11/02; E04B 2/72
See application file for complete search history.

(56) References Cited

U.S. PATENT DOCUMENTS 4,114,521 A * 9/1978 Busch ..... F24F 9/00 55/DIG. 29
4,164,901 A 8/1979 Everett
4,247,115 A * 1/1981 Nikoden, Jr. ..... F41J 11/00 108/60
4,598,631 A 7/1986 Everett
5,902,182 A 5/1999 Kramer
7,357,394 B2 4/2008 Halverson
9,599,357 B2 3/2017 Vogel
9,982,971 B2 * 5/2018 Park ..... F41J 11/02
2007/0117503 A1 5/2007 Warminsky
(Continued)

FOREIGN PATENT DOCUMENTS

DE 4009867 10/1991
KR 10-1637438 7/2016
KR 101849236 4/2018

OTHER PUBLICATIONS

Dec. 15, 2017 Email from Kara White to Brad Simon.
(Continued)

*Primary Examiner* — Jeffrey S Vanderveen
(74) *Attorney, Agent, or Firm* — McDonnell Boehnen Hulbert & Berghoff LLP

(57) ABSTRACT

A shooting stall includes a first wall, a second wall, and an axis. The first wall includes an upstream end, a downstream end, and a side surface that extends between the upstream end and the downstream end. The second wall is disposed substantially parallel to the first wall, and the second wall includes an upstream end, a downstream end, and a side surface facing the first wall that extends between the upstream end and the downstream end. The axis extends through the first wall and the second wall, where the axis is positioned between the upstream end and the downstream end of each of the first wall and second wall, and where the side surface of the second wall includes a first portion that extends from the axis and slopes away from the first wall.

22 Claims, 9 Drawing Sheets

(56) References Cited

U.S. PATENT DOCUMENTS

| | | | | |
|---|---|---|---|---|
| 2012/0247314 | A1 | 10/2012 | Bassett et al. | |
| 2014/0349564 | A1 | 11/2014 | Lamothe | |
| 2015/0184985 | A1 | 7/2015 | Stear | |
| 2016/0178329 | A1 | 6/2016 | Gibson | |
| 2017/0292818 | A1* | 10/2017 | Atluri | F41J 11/00 |

OTHER PUBLICATIONS

Red Rivers Firearms Quote, Apr. 16, 2016 Estimate #1081v4—1 each 100 yard, 3 lane fixed bay with rubber trap.
Texas Tactical Contract, Dec. 2, 2017 Estimate #1145—Bay 1=6 lanes, 15 years with rubber trap.
Red River—Old Style vs. Stealth Stall video, 2017.

* cited by examiner

SHOOTING STALLS AND RANGES

CROSS-REFERENCED TO RELATED APPLICATION

The present application claims the benefit of U.S. Provisional No. 62/805,022, filed Feb. 13, 2019, which is hereby incorporated by reference.

BACKGROUND

An indoor shooting range may include one or more shooting stalls for persons training with firearms. Each shooting stall may provide an enclosure for an occupant of the stall.

The shooting range may include an air handling system. The air handling system may be configured to remove toxic components from the air in the shooting range, including, for example, lead dust and other heavy metal dust from gunpowder.

SUMMARY

In one aspect, a shooting stall is disclosed. The shooting stall may include a first wall including an upstream end, a downstream end, and a side surface that extends between the upstream end and the downstream end; a second wall disposed substantially parallel to the first wall, the second wall including an upstream end, a downstream end, and a side surface facing the first wall that extends between the upstream end and the downstream end; and an axis extending through the first wall and the second wall, wherein the axis is positioned between the upstream end and the downstream end of each of the first wall and second wall, and wherein the side surface of the second wall comprises a first portion that extends from the axis and slopes away from the first wall.

In another aspect, a shooting stall is disclosed where the first portion of the side surface of the second wall extends from the axis toward the downstream end of the second wall.

In another aspect, a shooting stall is disclosed where the first portion of the side surface of the second wall is disposed at an angle in a range of 98 degrees to 116 degrees.

In another aspect, a shooting stall is disclosed where the first portion of the side surface of the second wall curves away from the first wall.

In another aspect, a shooting stall is disclosed where the first portion of the side surface of the second wall comprises a concave curve.

In another aspect, a shooting stall is disclosed where the first portion of the side surface of the second wall extends from the axis toward the upstream end of the second wall.

In another aspect, a shooting stall is disclosed where the side surface of the second wall includes a second portion that extends from the axis in a direction opposite the first portion and that slopes away from the first wall.

In another aspect, a shooting stall is disclosed where the side surface of the first wall includes a first portion that extends from the axis and slopes away from the second wall.

In another aspect, a shooting stall is disclosed where a first edge of the first portion of the side surface of the second wall is adjustable between first and second lateral positions, and wherein the first lateral position is closer to the first wall than the second lateral position.

In another aspect, a shooting stall is disclosed where the first portion of the side surface of the second wall is disposed at a first angle to the axis when the first edge is in the first lateral position and the first portion of the side surface of the second wall is disposed at a second angle to the axis when the first edge is in the second lateral position.

In another aspect, a shooting stall is disclosed that further includes a ceiling disposed over the first wall and the second wall, where a first portion of the ceiling is sloped downward from the upstream end of the first wall and the upstream end of the second wall to the axis, and where a second portion of the ceiling is sloped upward from the axis to the downstream end of the first wall and downstream end of the second wall.

In another aspect, a shooting stall is disclosed that further includes a first door coupled to the side surface of the first wall, where the first door is configured to orient substantially parallel to the axis, and a second door coupled to the side surface of the second wall, wherein the second door is configured to orient substantially parallel to the axis.

In another aspect, a shooting stall is disclosed. The shooting stall may include a first wall including an upstream end, a downstream end, and a side surface that extends between the upstream end and the downstream end; a second wall disposed substantially parallel to the first wall, the second wall including an upstream end, a downstream end, and a side surface facing the first wall that extends between the upstream end and the downstream end; and an axis extending through the first wall and the second wall, where the axis is positioned between the upstream end and the downstream end of each of the first wall and second wall, where the side surface of the first wall includes: a first portion that extends from the axis toward the downstream end of the first wall and that slopes away from the second wall, and a second portion that extends from the axis toward the upstream end of the first wall and that slopes away from the second wall, and where the side surface of the second wall includes: a first portion that extends from the axis toward the downstream end of the second wall and that slopes away from the first wall, and a second portion that extends from the axis toward the upstream end of the second wall and that slopes away from the first wall.

In another aspect, a shooting stall is disclosed where the first portion of the side surface of the first wall is disposed at an angle in a range of 101 degrees to 108 degrees.

In another aspect, a shooting stall is disclosed where the first portion of the side surface of the second wall is disposed at an angle in a range of 101 degrees to 108 degrees.

In another aspect, a shooting range is disclosed. The shooting range may include a plurality of walls that are substantially parallel and an axis that passes through the plurality of walls, each of the plurality of walls including an upstream end, a downstream end, a first side surface extending from the upstream end to the downstream end, and a second side surface extending from the upstream end to the downstream end, where the plurality of walls defines a plurality of shooting stalls, and where at least one shooting stall of the plurality of shooting stalls includes: a respective first side surface of one of the plurality of walls and an opposing respective second side surface of another of the plurality of walls, where the opposing respective second side surface comprises a first portion extending from the axis and sloping away from the respective first side surface; and an air handling system, where a parameter of the shooting range is selected based at least in part on the first portion of the opposing respective second side surface.

In another aspect, a shooting range is disclosed where the parameter of the shooting range comprises air volume supplied to the air handling system.

In another aspect, a shooting range is disclosed where the parameter of the shooting range comprises air speed at the axis.

In another aspect, a shooting range is disclosed where the first portion of the opposing respective second side surface is disposed at an angle in a range of 98 degrees to 116 degrees.

In another aspect, a shooting range is disclosed where the first portion of the opposing respective second side surface curves away from the first wall.

BRIEF DESCRIPTION OF THE DRAWINGS

The accompanying drawings, which are included to provide a further understanding of the disclosure, are incorporated in and constitute a part of this specification, illustrate embodiments of the disclosure.

DETAILED DESCRIPTION

I. Introduction

In a shooting range, an air handling system may be configured to remove toxic components in the air by providing an air supply that flows through the shooting range. For example, an occupant of a shooting stall may discharge (fire) his firearm at or behind a firing line, and the air supply may flow from upstream of the occupant through the firing line.

Disclosed herein are shooting stalls and ranges with sloped features, including, for example, sloped walls and a sloped ceiling. Beneficially, the sloped features may cause at least in part an increase in velocity of air that flows across the firing line and away from the occupant. Such an increase in the velocity of the air may increase the removal of the toxic components from the air in the shooting range. In some implementations, the shooting stalls and ranges described herein may improve efficiency of the air handling system and/or reduce the cost of energy to operate the air handling system. Further, disclosed herein are shooting stalls and ranges with doors that are configured to orient substantially parallel to an axis.

II. Example Apparatus

Figure 3A:
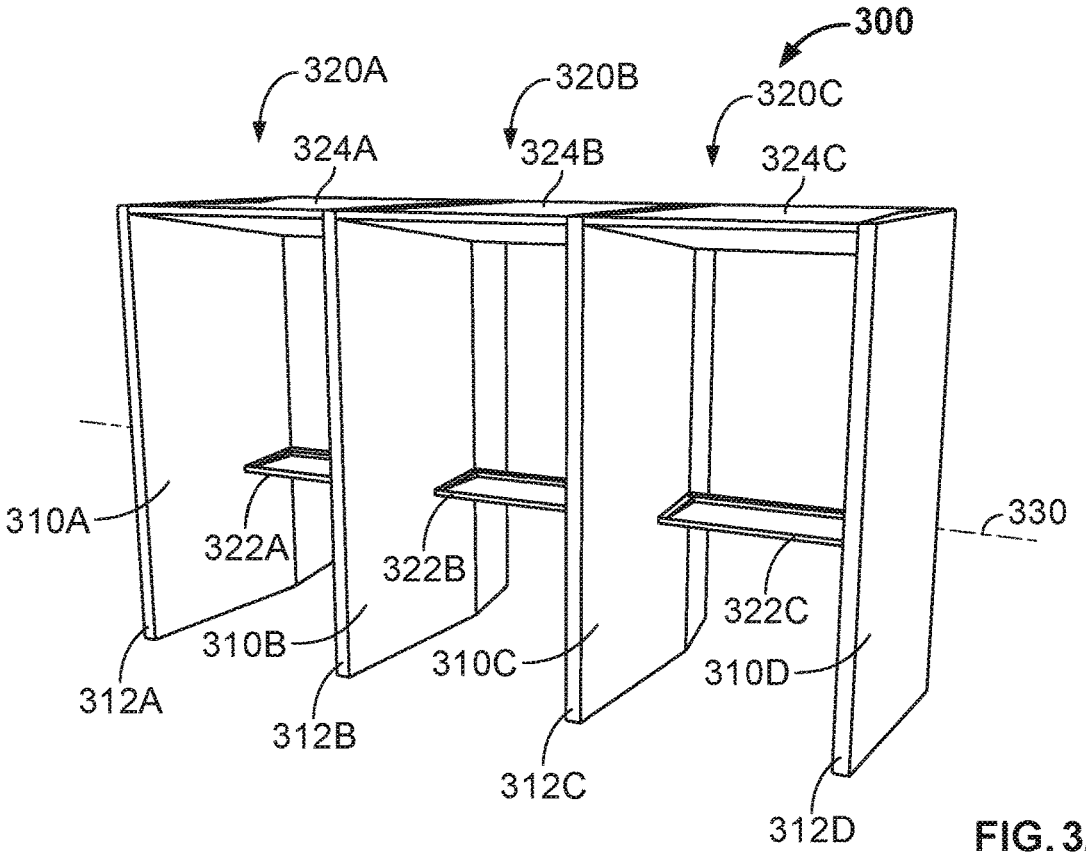
FIG. 3A shows aspects of a shooting range, according to an example embodiment.
Figure 3B:
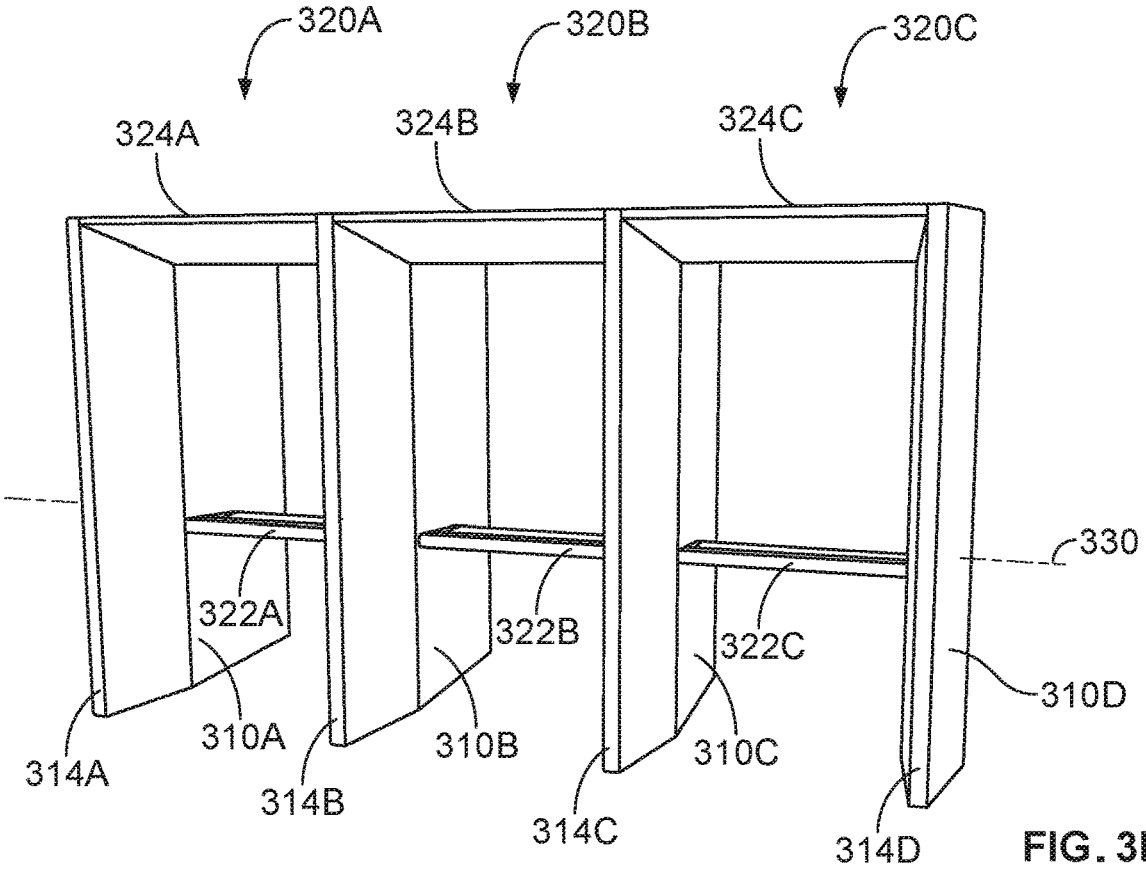
FIG. 3B shows aspects of a shooting range, according to an example embodiment.
Figure 4:
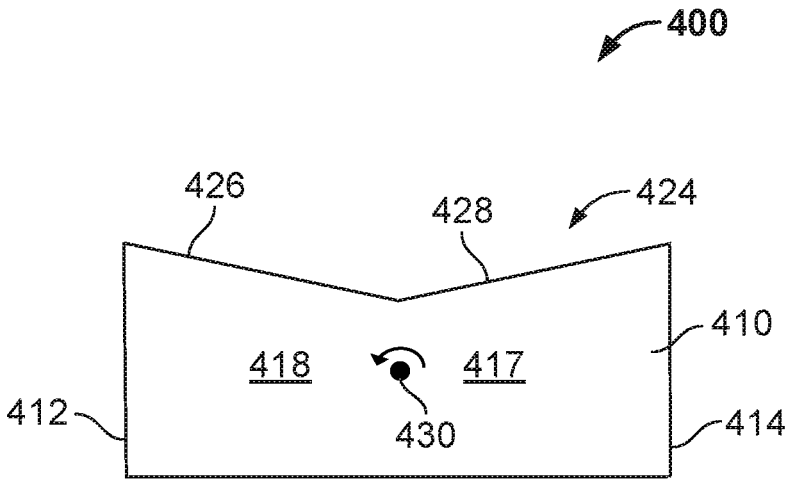
FIG. 4 shows aspects of a shooting stall, according to an example embodiment.

FIGS. 1-14 show shooting stalls, shooting ranges, aspects of shooting stalls, and aspects of shooting ranges, according to example embodiments. FIGS. 1-2 and 5-14 are plan views, FIGS. 3A and 3B are perspective views, and FIG. 4 is an elevation view. FIGS. 1-14 are provided for purposes of illustration only and components of the shooting stalls and shooting ranges depicted in the Figures are not to scale. Further, components of shooting stalls and shooting ranges depicted in the Figures with the same or similar reference numerals in different Figures may take the same or similar form and operate in the same or similar manner unless otherwise noted.

Figure 1:
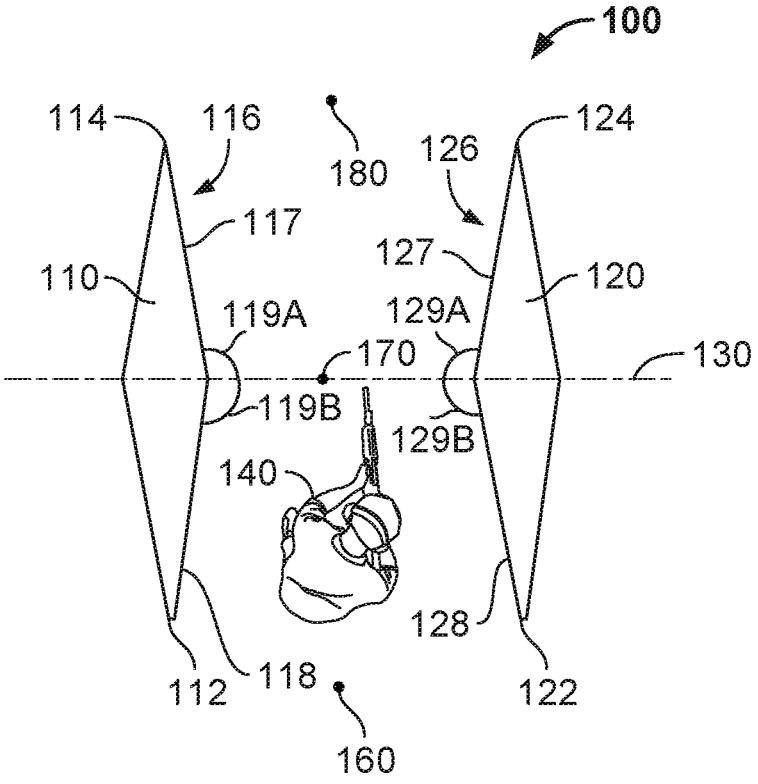
FIG. 1 shows a shooting stall, according to an example embodiment.

FIG. 1 shows a shooting stall 100, according to an example embodiment. The shooting stall 100 includes a first wall 110, a second wall 120 disposed substantially parallel to the first wall 110, and an axis 130 that extends through the first wall 110 and the second wall 120. In some embodiments, the first wall 110 and second wall 120 may form an enclosed space for an occupant 140. Further, in some embodiments, the axis 130 may be coplanar with a firing line of the shooting stall 100. The occupant 140 may discharge his firearm at or behind the firing line. The term "substantially parallel," as used in this disclosure, means exactly parallel or one or more deviations from exactly parallel that do not significantly impact air flow through shooting stalls as described herein (e.g., 1-3% off of parallel).

The first wall 110 includes an upstream end 112, a downstream end 114, and a side surface 116 that extends between the upstream end 112 and the downstream end 114. The axis 130 is positioned between the upstream end 112 and the downstream end 114. The side surface 116 includes a first portion 117 and a second portion 118. The first portion 117 extends from the axis 130 toward the downstream end 114, and the first portion 117 slopes away from the second wall 120. The first portion 117 is disposed at an angle 119A from the axis 130. Further, the second portion 118 extends from the axis 130 towards the upstream end 112, and the second portion 118 slopes away from the second wall 120. The second portion 118 is disposed at an angle 119B from the axis 130. In some embodiments, the first wall 110 may have a rhombus shape. Further, in some embodiments, the first wall 110 may be disposed four feet from the second wall 120.

The first portion 117 may take various forms. In some embodiments, the first portion 117 may extend at least one foot along the length of the first wall 110. Further, in some embodiments, the first portion 117 may extend from the axis 130 to the downstream end 114. Moreover, in some embodiments, the first portion 117 may extend the height of the first wall 110. The second portion 118 may take various forms as well. In some embodiments, the second portion 118 may extend at least one foot along the length of the first wall 110. Further, in some embodiments, the second portion 118 may extend from the axis 130 to the upstream end 112. Moreover, in some embodiments, the second portion 118 may extend the height of the second wall 120.

The angle 119A may take various forms. In some embodiments, the angle 119A may be an obtuse angle. Further, in some embodiments, the angle 119A may be in a range of 98 degrees to 116 degrees. Moreover, in some embodiments, the angle 119A may be in a range of 101 degrees and 108 degrees. Further, in some embodiments, the angle 119A may be static (fixed). The angle 119B may take various forms as well. In some embodiments, the angle 119B may be an obtuse angle. Further, in some embodiments, the angle 119B may be in a range of 98 to 116 degrees. Moreover, in some embodiments, the angle 119B may be in a range of 101 degrees and 108 degrees. Further, in some embodiments, the angle 119B may be static. The angle 119A may the same or different than the angle 119B.

The first wall 110 may be constructed from a variety of materials, including, for example, wood, steel, and concrete. Further, the first wall 110 may have a variety of dimensions, including, for example, a length in a range of 6 feet to 8 feet, and a height in a range of 8 feet to 10 feet.

The second wall 120 may have a similar arrangement as the first wall 110. The second wall 120 includes an upstream end 122, a downstream end 124, and a side surface 126 that extends between the upstream end 122 and the downstream end 124. The axis 130 is positioned between the upstream end 122 and the downstream end 124. The side surface 126 includes a first portion 127 and a second portion 128. The first portion 127 extends from the axis 130 toward the upstream end 124, and the first portion 127 slopes away from the first wall 110. The first portion 127 is disposed at an angle 129A from the axis 130. Further, the second portion 128 extends from the axis 130 towards the downstream end 122, and the second portion 128 slopes away from the first wall 110. The second portion 128 is disposed at an angle 129B from the axis 130.

The first portion 127 may take various forms. In some embodiments, the first portion 127 may extend at least one foot along the length of the second wall 120. Further, in some embodiments, the first portion 127 may extend from the axis 130 to the downstream end 124. The second portion 128 may take various forms as well. In some embodiments, the second portion 128 may extend at least one foot along the length of the second wall 120. Further, in some embodiments, the second portion 128 may extend from the axis 130 to the upstream end 122.

The angle 129A may take various forms. In some embodiments, the angle 129A may be an obtuse angle. Further, in some embodiments, the angle 129A may be in a range of 98 degrees to 116 degrees. Moreover, in some embodiments, the angle 129A may be in a range of 101 degrees and 108 degrees. Further, in some embodiments, the angle 129A may be static. The angle 129B may also take various forms as well. In some embodiments, the angle 129B may be an obtuse angle. Further, in some embodiments, the angle 129B may be in a range of 98 to 116 degrees. Moreover, in some embodiments, the angle 129B may be in a range of 101 and 108 degrees. Further, in some embodiments, the angle 129B may be static. The angle 129A may the same or different than the angle 129B. In some embodiments, the angle 119A may be the same as the angle 129A. Further, in some embodiments, the angle 119B may be the same as the angle 129B. However, in some embodiments, the angle 119A may be different than the angle 129A. Further, in some embodiments, the angle 119B may be different than the angle 129B.

The second wall 120 may be constructed of any of the materials of the first wall 110. In some embodiments, the second wall 120 may include the same materials as the first wall 110. Further, in some embodiments, the second wall 120 may include different materials than the first wall 110. Moreover, in some embodiments, the second wall 120 may have the same dimensions as the first wall 110. Further, in some embodiments, the second wall 120 may have different dimensions as the first wall 110.

The first portion 117 and second portion 118 each slope way from the side surface 126. Further, the first portion 127 and the second portion 128 each slope away from the side surface 117. Moreover, the first portion 117 slopes away from the first portion 127, the second portion 118 slopes away from the second portion 128, the first portion 127 slopes away from the first portion 117, and the second portion 128 slopes away from the second portion 118.

The first portions 117 and 127 and the second portions 118 and 128 may form a nozzle for air flow through the shooting stall 100. The first portions 117 and 127 and second portions 118 and 128 may cause at least in part an increase in velocity of air that flows across the axis 130 away from the occupant 140. For example, air speed (e.g., FPM) at axis location 170 may be greater than air speed at upstream location 160 and/or air speed at downstream location 180. In some embodiments, the air speed at upstream location 160 may be substantially equal to the air speed at downstream location 180, and the first portions 117 and 127 and the second portions 118 and 128 may cause the air speed at axis location 170 to be 1.25 greater than the air speed at upstream location 160 and the air speed at downstream location 180. The term "substantially equal," as used in this disclosure, means exactly equal or one or more deviations from exactly equal that do not significantly impact air flow through shooting stalls as described herein (e.g., 1-3% difference).

Figure 2:
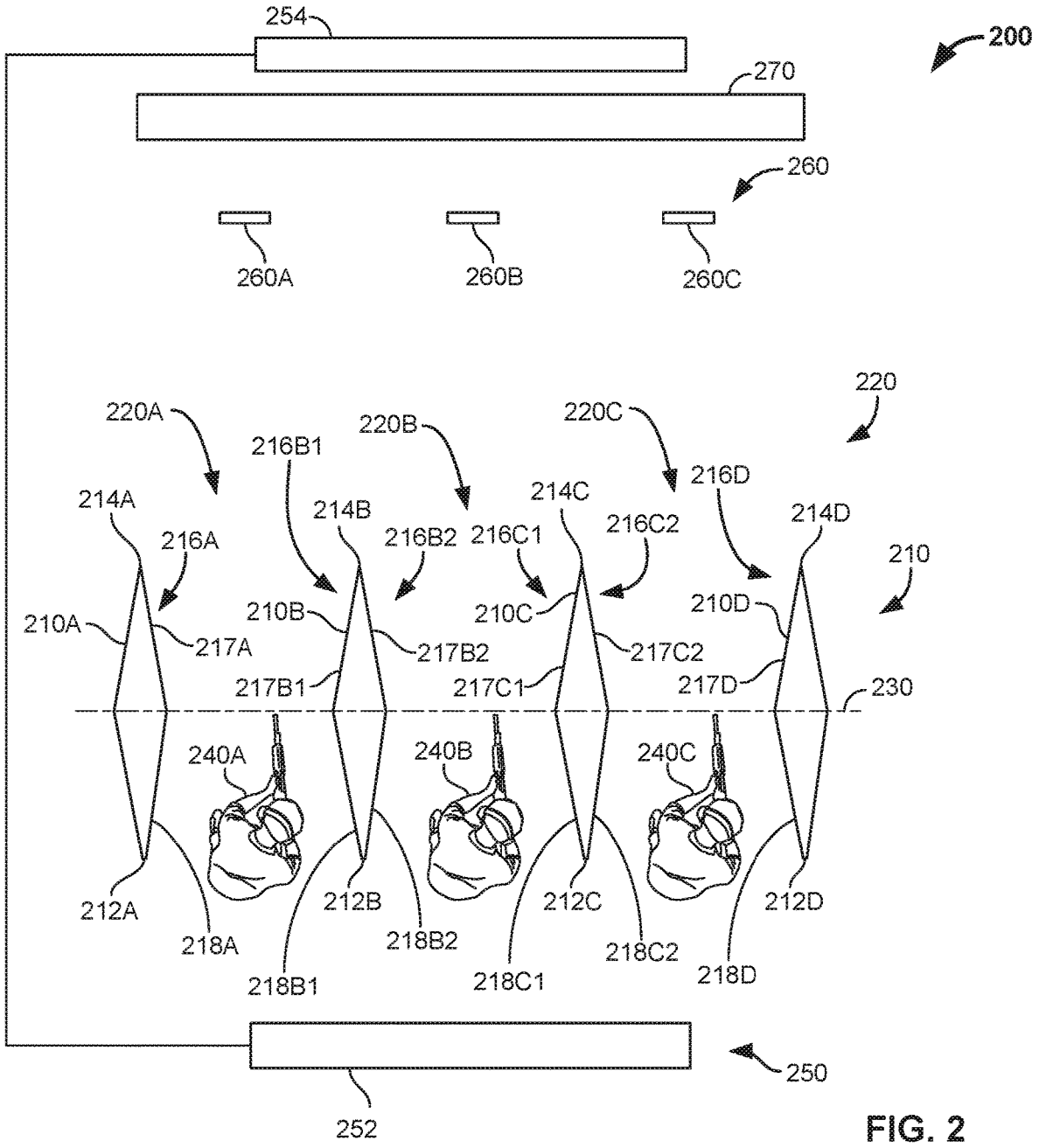
FIG. 2 shows a shooting range, according to an example embodiment.

FIG. 2 shows a shooting range 200, according to an example embodiment. The shooting range 200 includes a plurality of walls 210, an axis 230 that passes through the plurality of walls 210, an air handling system 250, a plurality of targets 260, and a backstop 270. The plurality of walls 210 defines a plurality of shooting stalls 220.

The plurality of walls 210 includes four walls 210A, 210B, 210C, and 210D. The walls 210A, 210B, 210C, and 210D are substantially parallel. In some embodiments, the plurality of walls may include more or less than four walls. For example, a plurality of walls may include between two walls to sixteen walls.

The plurality of shooting stalls 220 includes three stalls 220A, 220B, and 220C. In some embodiments, the plurality of shooting stalls may include more or less than three stalls. For example, a plurality of shooting stalls may include between two stalls and fifteen stalls. Occupants 240A-240C may discharge their firearms in shooting stalls 220A-C, respectively. Each of the occupants may discharge his firearm at or behind the axis 230.

The plurality of targets 260 includes three targets 260A, 260B, and 260C. In some embodiments, the plurality of targets 260 may include more or less than three targets. Each of the occupants may discharge his firearm at a corresponding target. The target 260A corresponds with the shooting stall 220A, the target 260B corresponds with the shooting stall 220B, and the target 260C corresponds with the shooting stall 260C. The backstop 270 may be configured to stop or absorb bullets from firearms.

Each of the walls 210A, 210B, 210C, and 210D include an upstream end (212A-212D, respectively), a downstream end (214A-214D, respectively), a first side surface extending from the upstream end to the downstream end, and a second side surface extending from the upstream end to the downstream end (216A, 216B1, 216B2, 216C1, 216C2, and 216D, respectively).

Each of the shooting stalls 220A, 220B, and 220C includes a respective first side surface of one of the walls and an opposing respective second side surface of another of the walls. The respective first side surface may slope away from the opposing respective side surface. For example, shooting stall 220A includes respective first side surface 216A and opposing respective second side surface 216B1. The respective first side surface 216A includes a first portion 217A and a second portion 218A, and the opposing respective second side surface 216B1 includes a first portion 217B1 and a second portion 218B1. The first portion 217A extends from the axis 230 toward the downstream end 214A, and the first portion 217A slopes away from the opposing second side surface 216B1. The second portion 218A extends from the axis 230 toward the upstream end 212A, and the second portion 218A slopes away from the opposing respective second side surface 216B1. The first portion 217B1 extends from the axis 230 toward the downstream end 214B, and the first portion 217B1 slopes away from the first respective side surface 216A. The second portion 218B1 extends from the axis 230 toward the upstream end 212B, and the second portion 218B1 slopes away from the first respective side surface 216A.

The first portions 217A and 217B1 and second portions 218A and 218B1 may each be disposed at an angle to the axis 230. Each of the angles may take the same or similar form as the angle 119A. In some embodiments, the portions (217A, 218A, 217B1, and 218B1) may each extend at least one foot along the length of the respective side surface (216A and 216B1). Further, in some embodiments, the portions (217A, 218A, 217B1, 218B1) may each extend from the axis 230 to the respective ends (212A, 214A, 212B, and 214B).

The shooting stalls 220B and 220C may each take the same or similar form as the shooting stall 220A. In this regard, the shooting stalls 220B and 220C each include a first respective side surface (216B2 and 216C2, respectively) and opposing respective second side surface (216C1 and 216D, respectively) with portions that slope away from the other side surface. The side surface 216B2 includes a first portion 217B2 and a second portion 218B2; the side surface 216C1 includes a first portion 217C1 and a second portion 218C1; the side surface 216C2 includes a first portion 217C2 and a second portion 218C2; and the side surface 216D includes a first portion 217D and a second portion 218D. Each of the portions 217B2, 218B2, 217C1, 218C1, 217C2, and 218C2 may be disposed at an angle to the axis 230. Each of the angles may take the same or similar form as the angle 119A. In some embodiments, the angles of the portions 217A, 218A, 217B1, 218B1, 217B2, 218B2, 217C1, 218C1, 217C2, 218C2, 217D, and 218D may be the same. Further, in some embodiments, the angles of at least two of the portions 217A, 218A, 217B1, 218B1, 217B2, 218B2, 217C1, 218C1, 217C2, 218C2, 217D, and 218D may be different.

The sloped portions of the walls 210A, 210B, 210C, and 210D (217A, 218A, 217B1, 218B1, 217B2, 218B2, 217C1, 218C1, 217C2, 218C2, 217D, and 218D) may cause at least in part an increase in velocity of air that flows across the axis 230. The sloped portions of the walls 210A, 210B, 210C, and 210D may cause an increase in the velocity of air that flows across the axis 230 in the same way as the first portions 117 and 127 and second portions 118 and 128 cause an increase in the velocity of air that flows across the axis 130.

The air handling system 250 may be configured to maintain an air flow in the shooting range 200 a range of 50 FPM to 75 FPM. The air handling system 250 includes an inlet 252 to the shooting range 200 and an outlet 254 from the shooting range. The inlet 252 is positioned upstream of the shooting stalls 220A, 220B, and 220C. The inlet 252 may be configured to provide air to the shooting range 200. The outlet 254 is positioned downstream of the shooting stalls 220A, 220B, and 220C. The outlet 254 may be configured to collect air that has flowed from the inlet 252 through the shooting range 200. The air handling system 250 includes at least one air mover. In some embodiments, the at least one mover may be coupled to the inlet 252 and/or the outlet 254. Further, in some embodiments, the at least one air mover may include one or more blowers, compressors, pumps, and other HVAC equipment.

In some embodiments, the outlet 254 may be configured to filter at least a portion of the collected air and transfer the filtered air to the inlet 252. The inlet 252 and the outlet 254 may each include blowers, compressors, pumps, and other HVAC equipment.

Beneficially, the sloped portions of the walls 210A, 210B, 210C, and 210D may result in a safety benefit for the shooting range 200. In some embodiments, the sloped portions of the walls 210A, 210B, 210C, and 210D may cause an increase in the velocity of air that flows across the axis 230, which may in turn increase removal of toxic components from the air in the shooting range 200. As one example, the increase in the velocity of air that flows across the axis 230 may result in an increase in toxic components collected by the outlet 252. The sloped portions of the walls 210A, 210B, 210C, and 210D may improve ventilation of the shooting range 200.

A parameter of the shooting range 200 may be selected based at least in part on the sloped portions of the shooting stalls 220A, 220B, and 220C. In some embodiments, the selected parameter may be the air volume supplied to the air handling system 250. Further, in some embodiments, the selected parameter may be the air speed at the axis 230.

Beneficially, the sloped portions of the walls 210A, 210B, 210C, and 210D may result in an energy benefit for the shooting range 200. In some embodiments, the sloped portions of the walls 210A, 210B, 210C, and 210D may cause an increase of velocity of air that flows across the axis 230, which may in turn permit a reduction in the air volume supplied to the inlet 252. Further, in some embodiments, the sloped portions of the walls 210A, 210B, 210C, and 210D may cause an increase of velocity of air that flows across the axis 230, which may in turn permit a reduction in the electrical power to operate the inlet 252 and/or the outlet 254.

Although the sloped portions of the walls 210A, 210B, 210C, and 210D are described above as having a safety benefit and an energy benefit for the shooting range 200, each sloped portion of each of the walls 210A, 210B, 210C, and 210D may have safety benefit and/or an energy benefit.

FIGS. 3A and 3B show aspects of a shooting range 300, according to an example embodiment. The shooting range 300 includes four walls 310A, 310B, 310C, and 310D, and an axis 330 that passes through the walls 310A, 310B, and 310C. Each of the walls include an upstream end (312A-312D, respectively) and a downstream end (314A-314D, respectively). FIG. 3A is a view of the shooting range 300 from the upstream ends of the walls, and FIG. 3B is a view of the shooting range 300 from the downstream ends of the walls. The walls 310A, 310B, 310C, and 310D each include the same or similar sloped portions as the walls 210A, 210B, 210C, and 210D.

The shooting stall 320A includes a shelf 322A and a ceiling 324A. The axis 330 may intersect an edge of the shelf 322A. The shelf 322A may provide a barrier for an occupant of the shooting stall 320. Further, the shelf 322A may provide a surface for the occupant in the shooting stall 320.

The shelf 322A may be constructed from a variety of materials, including, for example, any of the materials that the first wall 110 may be constructed.

The ceiling 324A is disposed over the walls 310A and 310B. The walls 310A and 310B and the ceiling 324A may form an enclosed space for an occupant of the shooting stall 320A. The ceiling 324A may be constructed from a variety of materials, including, for example, any of the materials that the first wall 110 may be constructed. In some embodiments, the ceiling 324A may be substantially flat. The term "substantially flat," as used in this disclosure, means exactly flat or one or more deviations from exactly flat that do not significantly impact air flow through shooting stalls described herein (e.g., 1-2% off of flat).

The shooting stall 320B includes a shelf 322B and a ceiling 324B, and the shooting stall 320C includes a shelf 322C and a ceiling 324C. The shelfs 322B and 322C may take the same or similar form and have similar connections as the shelf 322A. The ceilings 324B and 324C may take the same or similar form and have similar connections as the ceiling 324A.

In some embodiments, a shooting stall may include a sloped ceiling. FIG. 4 shows aspects of a shooting stall 400, according to an example embodiment. The shooting stall 400 includes a wall 410, a ceiling 424 disposed over the wall 410, and an axis 430 that passes through the wall (axis 430 is shown into and out of page). The wall 410 includes an upstream end 412, a downstream end 414, a first portion 417 of a side surface and a second portion 418 of the side surface. The ceiling 424 includes a first portion 426 and a second portion 428. The first portion 426 is sloped downward (e.g., sloped toward a floor of the shooting stall 400) from the upstream end 412 to the axis 430. The second portion 428 is sloped upward (e.g., sloped away from the floor of the shooting stall 400) from the axis 430 to the downstream end 414. In some embodiments, the slope of the first portion 426 may be the same as the slope of the second portion 428. As one example, the height of the ceiling 426 at the upstream end 412 may be 8 feet, the height of the ceiling 426 at the axis 430 may be 7 feet and 6 inches, and the height of the ceiling 426 at the downstream end may be 8 feet. Further, in some embodiments, the slope of the first portion 426 may be different than the slope of the second portion 428.

The first portion 427 and second portion 428 may cause at least in part an increase in velocity of air that flows across the axis 430, which may in turn increase removal of toxic components from the air in the shooting range. Further, the first portion 427 and second portion 428 may cause at least in part an increase in velocity of air that flows across the axis 430, which may in turn permit a reduction in air volume supplied to an air handling system and/or permit a reduction in the electrical power to operate an air handling system.

A shooting range may include shooting stalls including sloped walls and a sloped celling disposed over the sloped walls, and the sloped walls and sloped ceiling may each contribute to an increase in the velocity of air across an axis.

Figure 5:
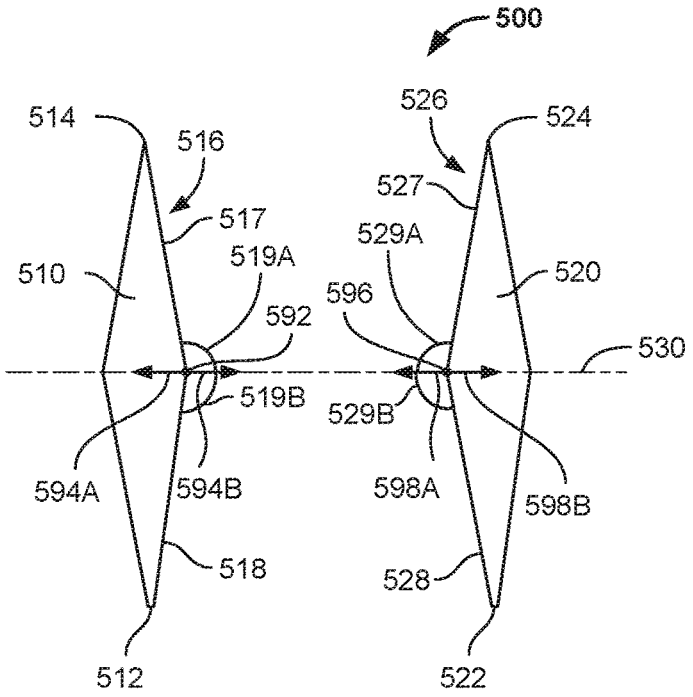
FIG. 5 shows a shooting stall, according to an example embodiment.

In some embodiments, a shooting stall may include a wall having an adjustable angle. FIG. 5 shows a shooting stall 500, according to an example embodiment. The shooting stall 500 includes a first wall 510, a second wall 520 disposed substantially parallel to the first wall 510, and an axis 530 that extends through the first wall 510 and the second wall 520. The first wall 510 includes an upstream end 512, a downstream end 514, and a side surface 516 that extends between the upstream end 512 and the downstream end 514. The axis 530 is positioned between the upstream end 512 and the downstream end 514. The side surface 516 includes a first portion 517 and a second portion 518.

The first portion 517 extends from the axis 530 toward the downstream end 514, and the first portion 517 slopes away from the second wall 520. The first portion 517 is disposed at an angle 519A from the axis 530. Further, the second portion 518 extends from the axis 530 towards the upstream end 512, and the second portion 518 slopes away from the second wall 520. The second portion 518 is disposed at an angle 519B from the axis 530.

The first portion 517 includes a first edge 592. The first edge 592 is configured to translate in directions 594A and 594B parallel to the axis 530. Translating the first edge 592 may change the value of the angle 519A and/or the angle 519B. In some embodiments, the first edge 592 may be adjustable between a first lateral position and a second lateral position, and the first lateral position may be closer to the second wall 520 than the second lateral position. Further, in some embodiments, the first portion 517 may be disposed at a first angle to the axis 530 when the first edge 592 is in the first lateral position and the first portion 517 may be disposed at a second angle when the first edge 592 is in the second lateral position.

The first edge 592 may be translated in directions 594A and 594B in a variety of ways. In some embodiments, the first edge 592 may be coupled to a track and the first edge 592 may be configured to translate along the track. Further, in some embodiments, the track may be disposed over the wall 510. Moreover, in some embodiments, the track may be disposed under the wall 510. Further, in some embodiments, the first edge 592 may be coupled to a motor and the first edge 592 may be configured to translate along the track via the motor.

The second wall 520 may have a similar arrangement as the first wall 510. The second wall 520 includes an upstream end 522, a downstream end 524, and a side surface 526 that extends between the upstream end 522 and the downstream end 524. The axis 530 is positioned between the upstream end 522 and the downstream end 524. The side surface 526 includes a first portion 527 and a second portion 528. The first portion 527 extends from the axis 530 toward the upstream end 524, and the first portion 527 slopes away from the first wall 510. The first portion 527 is disposed at an angle 529A from the axis 530. Further, the second portion 528 extends from the axis 530 towards the downstream end 522, and the second portion 528 slopes away from the first wall 510. The second portion 528 is disposed at an angle 529B from the axis 530.

The first portion 527 includes a first edge 596. The first edge 596 is configured to translate in directions 598A and 598B parallel to the axis 530. Translating the first edge 596 may change the value of the angle 529A and/or the angle 529B. In some embodiments, the first edge 596 may be adjustable between a first lateral position and a second lateral position, and the first lateral position may be closer to the first wall 510 than the second lateral position. Further, in some embodiments, the first portion 527 may be disposed at a first angle to the axis 530 when the first edge 596 is in the first lateral position and the first portion 527 may be disposed at a second angle when the first edge 596 is in the second lateral position. The first edge 596 may be translated in the same or similar way as the first edge is translated.

Figure 6:
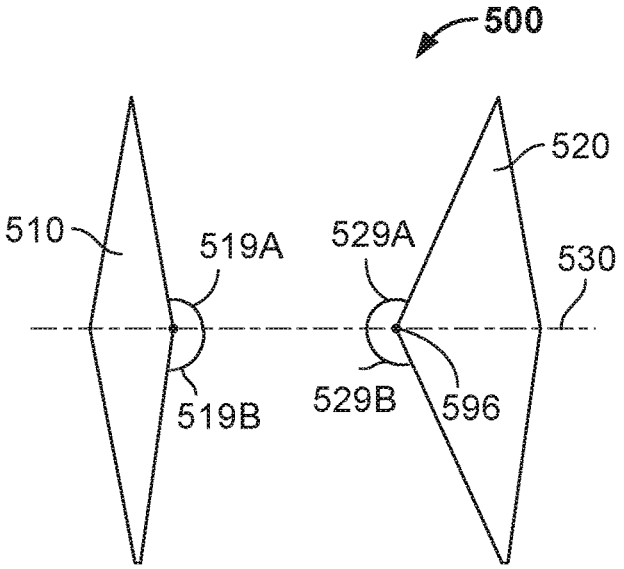
FIG. 6 shows a shooting stall in a first state, according to an example embodiment.
Figure 7:
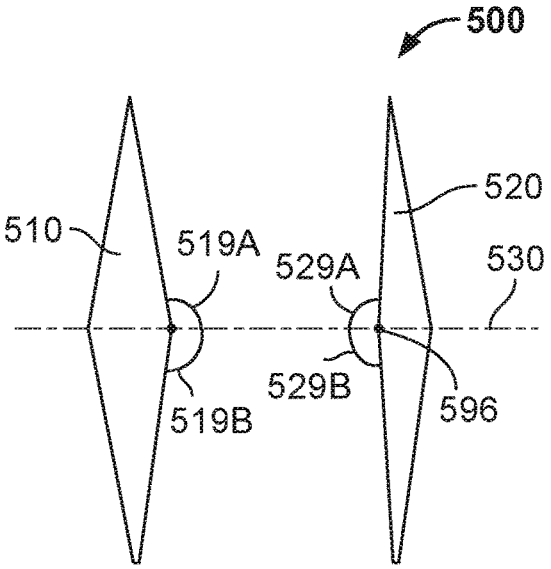
FIG. 7 shows a shooting stall in a second state, according to an example embodiment.

FIG. 6 shows the shooting stall 500 in a first state, according to an example embodiment. In FIG. 6, the first edge 596 is in the first lateral position. FIG. 7 shows the shooting stall 500 in a second state, according to an example embodiment. In FIG. 7, the first edge 596 is in the second lateral position. The value of the angle 529A in the first state is less than the value of the angle 529A in the second state. Further, the value of the angle 529B in the first state is less than the value of the angle 529B in the second state.

Figure 8:
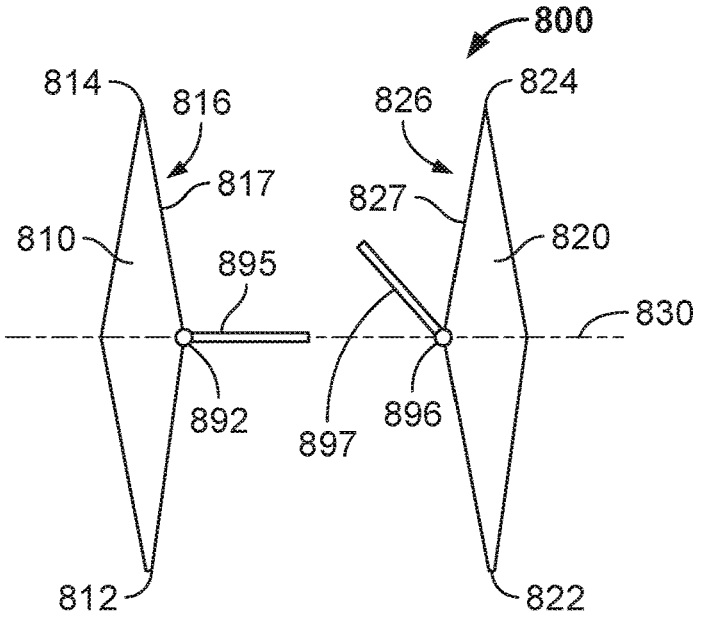
FIG. 8 shows a shooting stall, according to an example embodiment.

FIG. 8 shows a shooting stall 800, according to an example embodiment. The shooting stall 800 includes a first wall 810, a second wall 820 disposed substantially parallel to the first wall 810, an axis 830 that extends through the first wall 810 and the second wall 820, a first door 895, and a second door 897.

The first wall 810 includes an upstream end 812, a downstream end 814, and a side surface 816 that extends between the upstream end 812 and the downstream end 814. The axis 830 is positioned between the upstream end 812 and the downstream end 814. The side surface 816 includes a first portion 817. The first portion 817 extends from the axis 830 towards the downstream end 814, and the first portion 817 slopes away from the second wall 820.

The first door 895 is coupled to the side surface 816 at edge 892. The first door 895 is configured to (i) orient in a first position substantially parallel to the first portion 817 and (ii) orient in a second position substantially parallel to the axis 830. The first door 895 may be constructed of a variety of materials, including, for example, glass, wood, steel, and concrete. The first door 895 may orient in the first and second positions in a variety of ways. In some embodiments, the first door 895 may be rotatably coupled to the first edge 892 and the first door 895 may be configured to orient in the first and second positions via rotation around the first edge 892. Further, in some embodiments, the first door 895 may be coupled to a motor and the first door 895 may be configured to rotate the first door 895 around the first edge 892 via the motor.

The second wall 820 may have a similar arrangement as the first wall 810. The second wall 820 includes an upstream end 822, a downstream end 824, and a side surface 826 that extends between the upstream end 822 and the downstream end 824. The axis 830 is positioned between the upstream end 822 and the downstream end 824. The side surface 826 includes a first portion 827. The first portion 827 extends from the axis 830 towards the downstream end 824, and the first portion 827 slopes away from the first wall 810.

The second door 897 is coupled to the side surface 826 at edge 896. The second door 897 is configured to (i) orient in a first position substantially parallel to the first portion 827 and (ii) orient in a second position substantially parallel to the axis 830. The second door 897 may be constructed of any of the materials that the first door 895 is constructed. The second door 897 may orient in the first and second positions in a similar way as the first door 895.

The shooting stall 800 is in an open state when the first door 895 is oriented substantially parallel to the first portion 817 and the second door 897 is oriented substantially parallel to the first portion 827. When the shooting stall is the open state, air might flow across the axis 830. The shooting stall 800 is in a closed state when the first door 895 and second door 897 are each oriented substantially parallel to the axis 830. When the shooting stall 800 is in the closed state, air might not flow across the axis 830. In some embodiments, the first door 895 and second door 897 may each be coupled to a timer. After a predetermined time period has elapsed on the timer, the first door 895 may orient from the first position to the second position. Further, after the predetermined time period has elapsed on the timer, the second door 897 may orient from the first position to the second position.

Figure 9:
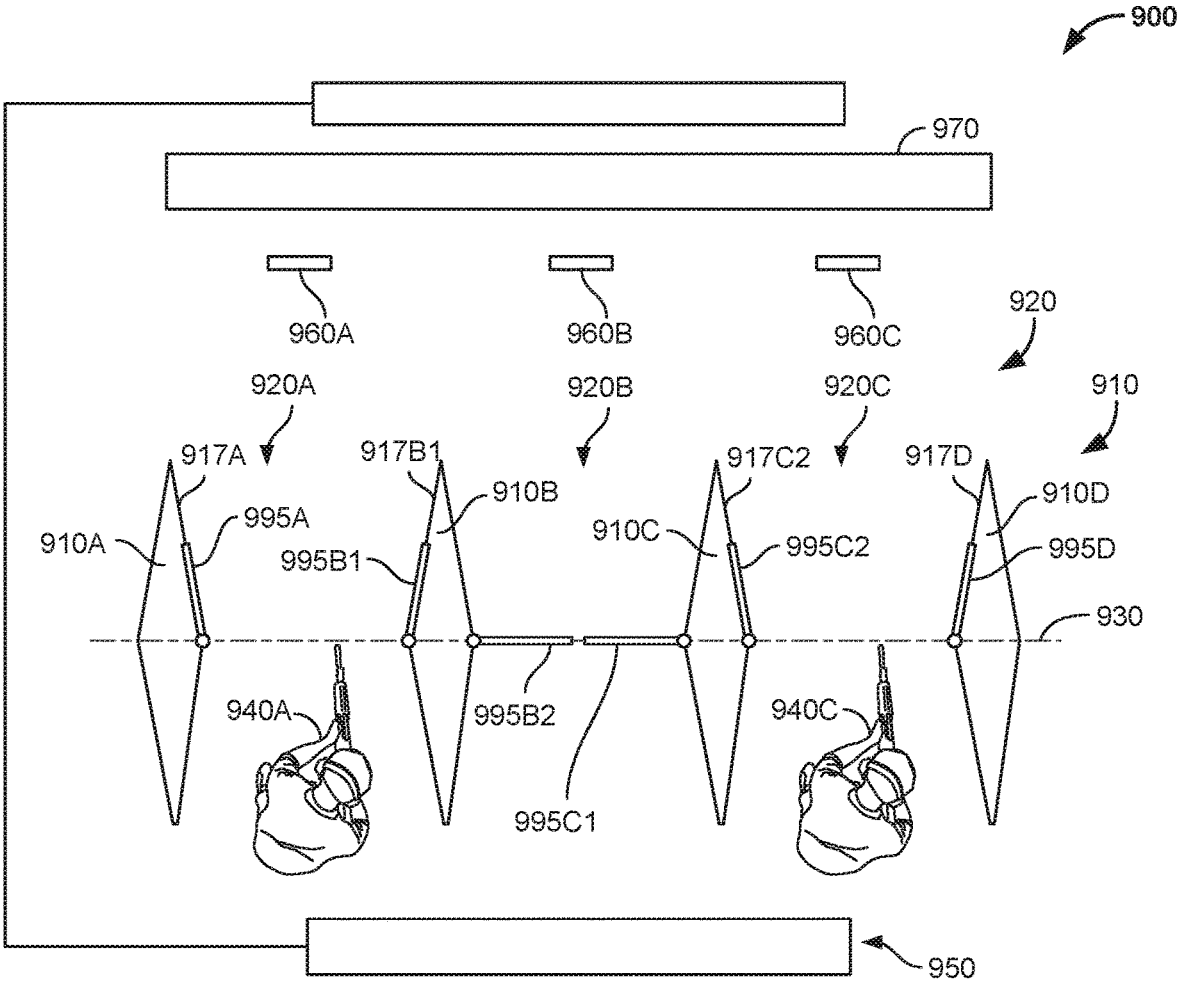
FIG. 9 shows a shooting range, according to an example embodiment.

FIG. 9 shows a shooting range 900, according to an example embodiment. The shooting range 900 includes a plurality of walls 910, an axis 930 that passes through the plurality of walls 910, an air handling system 950, a plurality of targets 960, and a backstop 970. The plurality of walls 910 defines a plurality of shooting stalls 920.

The plurality of shooting stalls 920 includes three stalls 920A, 920B, and 920C. Occupants 940A and 940C occupy stalls 920A and 920C, respectively. The shooting stalls 920A, 920B, and 920C may each take the same or similar form as the shooting stall 800.

In FIG. 9, the shooting stall 920A and shooting stall 920C are each in the open state. First door 995A is oriented substantially parallel to first portion 917A, second door 995B1 is oriented substantially parallel to first portion 917B1, first door 995C2 is oriented substantially parallel to first portion 917C2, and second door 955D is oriented substantially parallel to first portion 917D. Further, in FIG. 9, the shooting stall 920B is in the closed state. First door 995B2 and second door 995C1 are each oriented substantially parallel to the axis 930. Beneficially, when shooting stall 920B is in the closed state, the cost of energy to operate the air handling system 950 may be reduced by 33% as compared to the cost of energy to operate the air handling system when each of the shooting stalls 920A, 920B, and 920 is in the open state.

While the embodiments in FIGS. 8 and 9 include shooting stalls with doors located on both adjacent walls, in some embodiments, the shooting stalls may include a single door adjacent to one wall of the shooting stall. Further, in some embodiments, the shooting stall includes one or more doors that slide or roll so as to place the shooting stall in a closed state.

Figure 10:
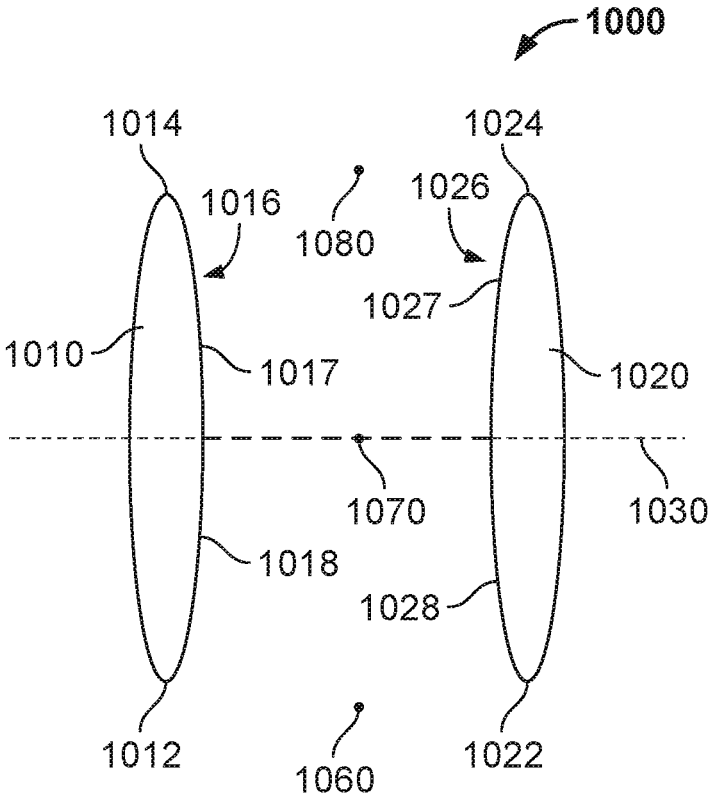
FIG. 10 shows a shooting stall, according to an example embodiment.

In some embodiments, a shooting stall may include a wall having curved portions. FIG. 10 shows a shooting stall 1000, according to an example embodiment. The shooting stall 1000 includes a first wall 1010, a second wall 1020 disposed substantially parallel to the first wall 1010, and an axis 1030 that extends through the first wall 1010 and the second wall 1020.

The first wall 1010 includes an upstream end 1012, a downstream end 1014, and a side surface 1016 that extends between the upstream end 1012 and the downstream end 1014. The axis 1030 is positioned between the upstream end 1012 and the downstream end 1014. The side surface 1016 includes a first portion 1017 and a second portion 1018. The first portion 1017 extends from the axis 1030 toward the downstream end 1014, and the first portion 1017 curves away from the second wall 1020. Further, the second portion 1018 extends from the axis 1030 towards the upstream end 1012, and the second portion 1018 curves away from the second wall 1020. In some embodiments, the first wall 1010 may have an elliptical shape.

The first portion 1017 may take various forms. In some embodiments, the first portion 1017 may extend at least one foot along the length of the first wall 1010. Further, in some embodiments, the first portion 1017 may extend from the axis 1030 to the downstream end 1014. Moreover, in some embodiments, the first portion 1017 may extend the height of the first wall 1010. The second portion 1018 may take various forms as well. In some embodiments, the second portion 1018 may extend at least one foot along the length of the first wall 1010. Further, in some embodiments, the second portion 1018 may extend from the axis 1030 to the upstream end 1012. Moreover, in some embodiments, the second portion 1018 may extend the height of the first wall 1010.

The second wall 1020 may have a similar arrangement as the first wall 1010. The second wall 1020 includes an upstream end 1022, a downstream end 1024, and a side surface 1026 that extends between the upstream end 1022 and the downstream end 1024. The axis 1030 is positioned between the upstream end 1022 and the downstream end 1024. The side surface 1026 includes a first portion 1027 and a second portion 1028. The first portion 1027 extends from the axis 1030 toward the upstream end 1024, and the first portion 1027 curves away from the first wall 1010. Further, the second portion 1028 extends from the axis 1030 towards the downstream end 1022, and the second portion 1028 curves away from the first wall 1010.

The first portion 1027 may take various forms. In some embodiments, the first portion 1027 may extend at least one foot along the length of the second wall 1020. Further, in some embodiments, the first portion 1027 may extend from the axis 1030 to the downstream end 1024. The second portion 1028 may take various forms as well. In some embodiments, the second portion 1028 may extend at least one foot along the length of the second wall 1020. Further, in some embodiments, the second portion 1028 may extend from the axis 1030 to the upstream end 1022.

The first portion 1017 and second portion 1018 each curve away from the side surface 1026. Further, the first portion 1027 and the second portion 1028 each curve away from the side surface 1017. Moreover, the first portion 1017 curves away from the first portion 1027, the second portion 1018 curves away from the second portion 1028, the first portion 1027 curves away from the first portion 1017, and the second portion 1028 curves away from the second portion 1018.

The first portions 1017 and 1027 and the second portions 1018 and 1028 may form a nozzle for air flow through the shooting stall 1000. The first portions 1017 and 1027 and second portions 1018 and 1028 may cause at least in part an increase in velocity of air that flows across the axis 1030. For example, air speed at axis location 1070 may be greater than air speed at upstream location 1060 and/or air speed at downstream location 1080.

Figure 11:
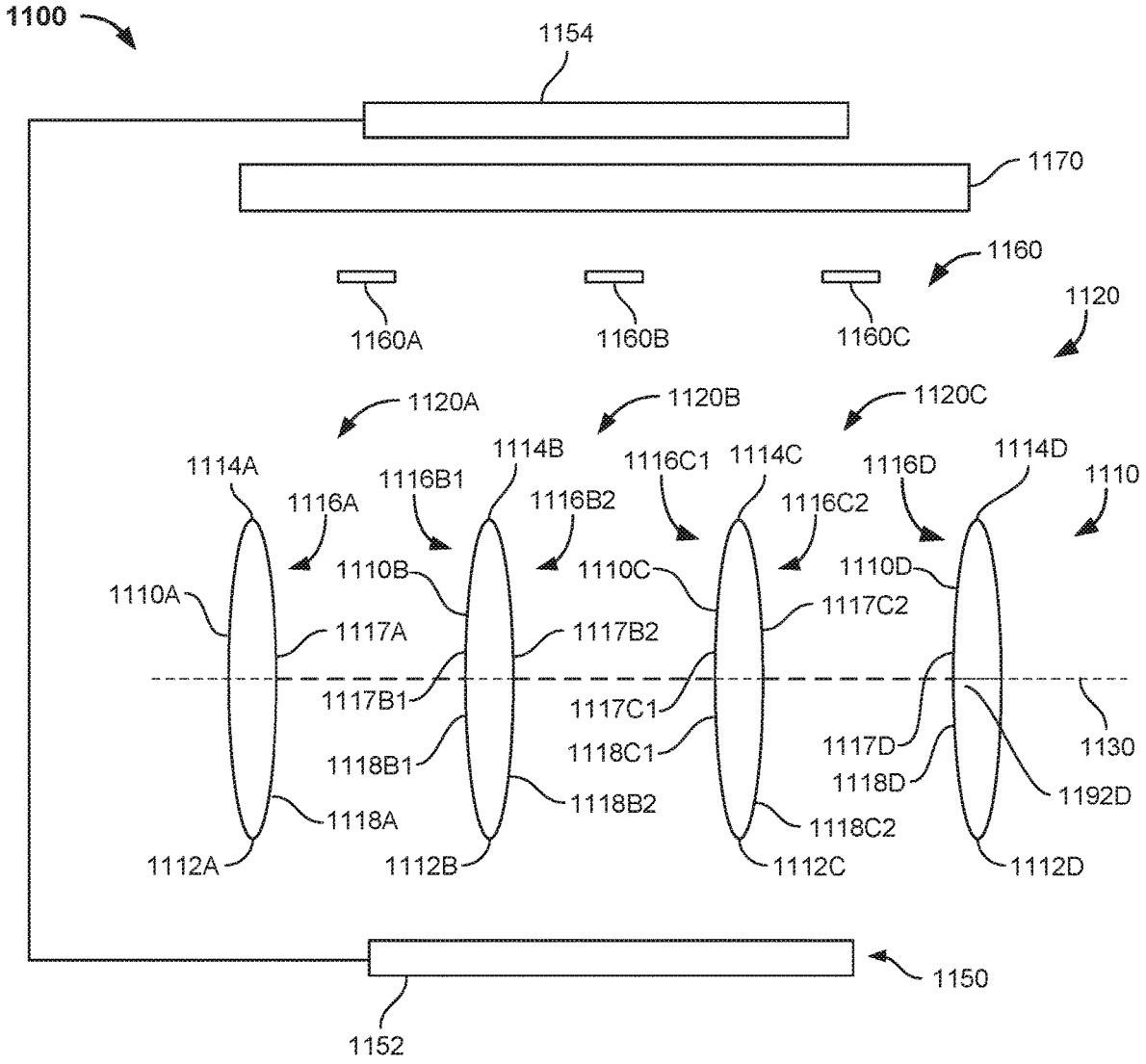
FIG. 11 shows a shooting range, according to an example embodiment.

FIG. 11 shows a shooting range 1100, according to an example embodiment. The shooting range 1100 includes a plurality of walls 1110, an axis 1130 that passes through the plurality of walls 1110, an air handling system 1150, a plurality of targets 1160, and a backstop 1170. The plurality of walls 1110 defines a plurality of shooting stalls 1120.

The plurality of walls 1110 includes four walls 1110A, 1110B, 1110C, and 1110D. The walls 1110A, 1110B, 1110C, and 1110D are substantially parallel. The plurality of shooting stalls 1120 includes three stalls 1120A, 1120B, and 1120C.

Each of the walls 1110A, 1110B, 1110C, and 1110D include an upstream end (1112A-1112D, respectively), a downstream end (1114A-1114D, respectively), a first side surface extending from the upstream end to the downstream end, and a second side surface extending from the upstream end to the downstream end (1116A, 1116B1, 1116B2, 1116C1, 1116C2, and 1116D, respectively).

Each of the shooting stalls 1120A, 1120B, and 1120C includes a respective first side surface of one of the walls and an opposing respective second side surface of another of the walls. The respective first side surface may curve away from the opposing respective side surface. For example, shooting stall 1120A includes respective first side surface 1116A and opposing respective second side surface 1116B1. The respective first side surface 1116A includes a first portion 1117A and a second portion 1118A, and the opposing respective second side surface 1116B1 includes a first portion 1117B1 and a second portion 1118B1. The first portion 1117A extends from the axis 1130 toward the downstream end 1114A, and the first portion 1117A curves away from the opposing second side surface 1116B1. The second portion 1118A extends from the axis 1130 toward the upstream end 1112A, and the second portion 1118A curves away from the opposing respective second side surface 1116B1. The first portion 1117B1 extends from the axis 1130 toward the downstream end 1114B, and the first portion 1117B1 curves away from the first respective side surface 1116A. The second portion 1118B1 extends from the axis 1130 toward the upstream end 1112B, and the second portion 1118B1 curves away from the first respective side surface 1116A.

In some embodiments, the portions (1117A, 1118A, 1117B1, and 1118B1) may each extend at least one foot along the length of the respective side surface (1116A and 1116B1). Further, in some embodiments, the portions (1117A, 1118A, 1117B1, 1118B1) may each extend from the axis 1130 to the respective ends (1112A, 1114A, 1112B, and 1114B).

The shooting stalls 1120B and 1120C may each take the same or similar form as the shooting stall 1120A. In this regard, the shooting stalls 1120B and 1120C each include a first respective side surface (1116B2 and 1116C2, respectively) and opposing respective second side surface (1116C1 and 1116D, respectively) with portions that curve away from the other side surface. The side surface 1116B2 includes a first portion 1117B2 and a second portion 1118B2; the side surface 1116C1 includes a first portion 1117C1 and a second portion 1118C1; the side surface 1116C2 includes a first portion 1117C2 and a second portion 1118C2; and the side surface 1116D includes a first portion 1117D and a second portion 1118D.

The curved portions of the walls 1110A, 1110B, 1110C, and 1110D (1117A, 1118A, 1117B1, 1118B1, 1117B2, 1118B2, 1117C1, 1118C1, 1117C2, 1118C2, 1117D, and 1118D) may cause at least in part an increase in velocity of air that flows across the axis 1130. The curved portions of the walls 1110A, 1110B, 1110C, and 1110D may cause an increase in the velocity of air that flows across the axis 1130 in the same way as the first portions 1017 and 1027 and second portions 1018 and 1028 cause an increase in the velocity of air that flows across the axis 1030.

Beneficially, the curved portions of the walls 1110A, 1110B, 1110C, and 1110D may result in a safety benefit for the shooting range 1100 in a similar way as the sloped portions of the walls 210A, 210B, 210C, and 210D result in a safety benefit for the shooting range 200.

A parameter of the shooting range 1100 may be selected based at least in part on the curved portions of the shooting stalls 1120A, 1120B, and 1120C. In some embodiments, the selected parameter may be the air volume supplied to the air handling system 1150. Further, in some embodiments, the selected parameter may be the air speed at the axis 1130.

Beneficially, the curved portions of the walls 1110A, 1110B, 1110C, and 1110D may result in an energy benefit for the shooting range 1100 in a similar way as the sloped portions of the walls 210A, 210B, 210C, and 210D result in an energy benefit for the shooting range 200.

Although the curved portions of the walls 1110A, 1110B, 1110C, and 1110D are described above as having a safety benefit and an energy benefit for the shooting range 1100, each curved portion of each of the walls 1110A, 1110B, 1110C, and 1110D may have safety benefit and/or an energy benefit.

Figure 12:
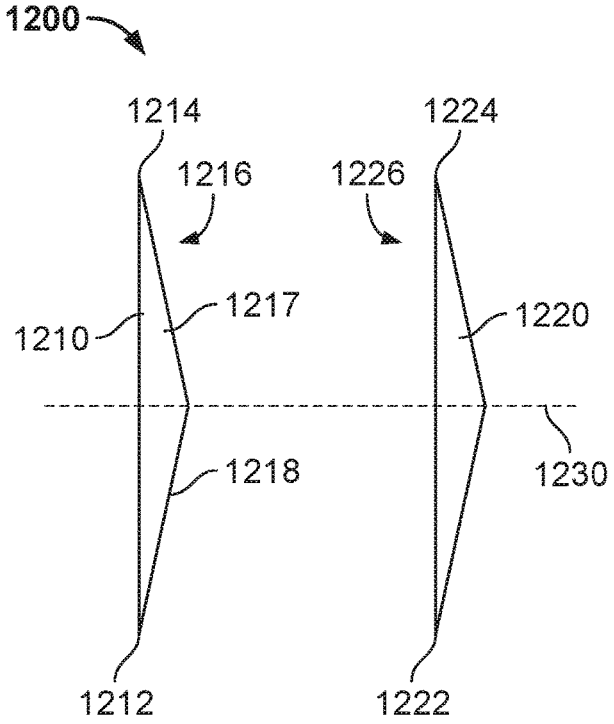
FIG. 12 shows a shooting stall, according to an example embodiment.

Other arrangements of shooting stalls are possible. FIG. 12 shows a shooting stall 1200, according to an example embodiment. The shooting stall 1200 includes a first wall 1210, a second wall 1220 disposed substantially parallel to the first wall 1210, and an axis 1230 that extends through the first wall 1220 and the second wall 1220.

The first wall 1210 includes an upstream end 1212, a downstream end 1214, and a side surface 1216 that extends between the upstream end 1212 and the downstream end 1214. The axis 1230 is positioned between the upstream end 1212 and the downstream end 1214. The side surface 1216 includes a first portion 1217 and a second portion 1218. The side surface 1216 takes the same or similar form as the side surface 116, the first portion 1217 takes the same or similar form as the first portion 117, and the second portion 1218 takes the same or similar form as the second portion 118. In some embodiments, the first wall 1210 may have a triangular shape.

The second wall 1210 includes an upstream end 1222, a downstream end 1224, and a side surface 1226 that extends between the upstream end 1222 and the downstream end 1224. The axis 1230 is positioned between the upstream end 1222 and the downstream end 1224. The side surface 1026 is substantially perpendicular to the axis 1230. The term "substantially perpendicular," as used herein, means exactly perpendicular or one or more deviations from exactly perpendicular that do not significantly impact air flow through stalls as described herein (e.g. 1-3% off of perpendicular). The first portion 1217 and second portion 1018 may cause at least in part an increase in velocity of air that flows across the axis 1230.

Figure 13:
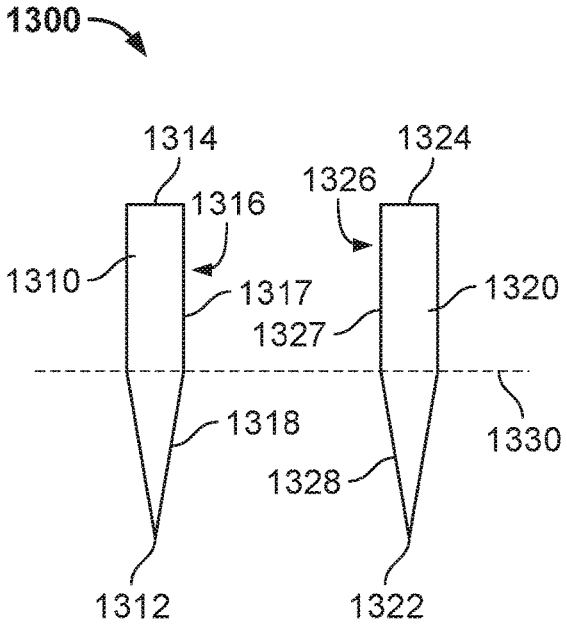
FIG. 13 shows a shooting stall, according to an example embodiment.

FIG. 13 shows a shooting stall 1300, according to an example embodiment. The shooting stall 1300 includes a first wall 1310, a second wall 1320 disposed substantially parallel to the first wall 1310, and an axis 1330 that extends through the first wall 1310 and the second wall 1320.

The first wall 1310 includes an upstream end 1312, a downstream end 1314, and a side surface 1316 that extends between the upstream end 1312 and the downstream end 1314. The axis 1330 is positioned between the upstream end 1312 and the downstream end 1314. The side surface 1316 includes a first portion 1317 and a second portion 1318. The first portion 1317 is substantially perpendicular to the axis 1330. The second portion 1318 takes the same or similar form as the second portion 118. In some embodiments, the first wall 1310 may have pentagon shape.

The first portion 1317 may take various forms. In some embodiments, the first portion 1317 may extend at least one foot along the length of the first wall 1310. Further, in some embodiments, the first portion 1317 may extend from the axis 1330 to the downstream end 1314. Moreover, in some embodiments, the first portion 1317 may extend the height of the first wall 1310.

The second wall 1320 may have a similar arrangement as the first wall 1310. The second wall 1320 includes an upstream end 1322, a downstream end 1324, and a side surface 1326 that extends between the upstream end 1322 and the downstream end 1324. The axis 1330 is positioned between the upstream end 1322 and the downstream end 1324. The first portion 1327 is substantially perpendicular to the axis 1330. The second portion 1328 takes the same or similar form as the second portion 128.

The first portion 1327 may take various forms. In some embodiments, the first portion 1327 may extend at least one foot along the length of the second wall 1320. Further, in some embodiments, the first portion 1327 may extend from the axis 1330 to the downstream end 1314. Moreover, in some embodiments, the first portion 1327 may extend the height of the second wall 1320. The second portion 1318 and second portion 1328 may cause at least in part an increase in velocity of air that flows across the axis 1330.

Figure 14:
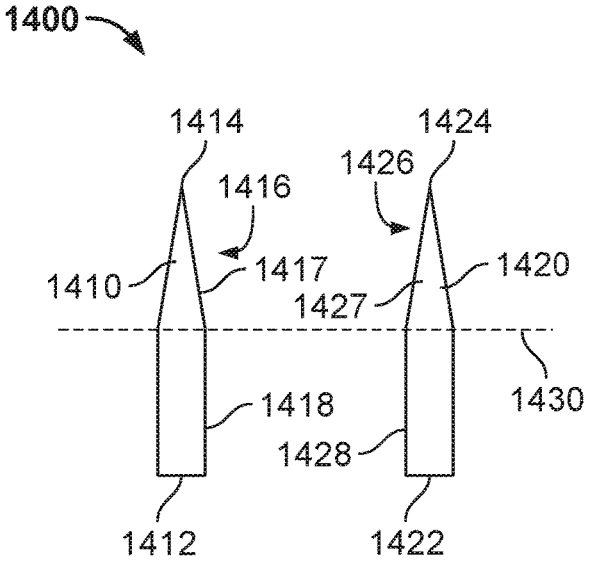
FIG. 14 shows a shooting stall, according to an example embodiment.

FIG. 14 shows a shooting stall 1400, according to an example embodiment. The shooting stall 1400 includes a first wall 1410, a second wall 1420 disposed substantially parallel to the first wall 1410, and an axis 1430 that extends through the first wall 1420 and the second wall 1420. The first wall 1410 may be an inverse of the first wall 1310, and the second wall 1420 may be an inverse of the second wall 1320.

The first wall 1410 includes an upstream end 1412, a downstream end 1414, and a side surface 1416 that extends between the upstream end 1412 and the downstream end 1414. The axis 1430 is positioned between the upstream end 1412 and the downstream end 1414. The side surface 1416 includes a first portion 1417 and a second portion 1418. The first portion 1417 takes the same or similar form as the first portion 117. The second portion 1418 is substantially perpendicular to the axis 1430.

The second wall 1420 may have a similar arrangement as the first wall 1410. The second wall 1420 includes an upstream end 1422, a downstream end 1424, and a side surface 1426 that extends between the upstream end 1422 and the downstream end 1424. The axis 1430 is positioned between the upstream end 1422 and the downstream end 1424. The first portion 1427 takes the same or similar form as the first portion 127. The second portion 1428 is substantially perpendicular to the axis 1430. The first portion 1417 and first portion 1427 may cause at least in part an increase in velocity of air that flows across the axis 1430.

In some embodiments, a shooting stall may include two walls and only one portion of one of the walls slopes away from the other wall. As one example, the portion may extend from an axis to a downstream end of the wall. The portion may take the form of the portion 117. As another example, the portion may extend from the axis to an upstream end of the wall. The portion may take the same or similar form as the portion 118.

Further, in some embodiments, a shooting stall may include two walls and only one portion of one of the walls curves away from the other wall. As one example, the portion may extend from an axis to a downstream end of the wall. The portion may take the same or similar form as the portion 1017. As another example, the portion may extend from the axis to an upstream end of the wall. The portion may take the same or similar form as the portion 1018.

A shooting range may include a combination of any of the shooting stalls described herein. For example, a shooting range may include shooting stall 100, shooting stall 1000, shooting stall 1200, shooting stall 1300, and shooting stall 1400. Further, any of the shooting stalls described herein may include doors that take the same or similar form as doors 895 and 897. Moreover, any of the shooting stalls described herein may include a ceiling that takes the same or similar form as the ceiling 324A or the ceiling 424.

III. Conclusion

Examples given above are merely illustrative and are not meant to be an exhaustive list of all possible embodiments, applications or modifications of the disclosure. Thus, various modifications and variations of the described methods and systems of the disclosure will be apparent to those skilled in the art without departing from the scope and spirit of the disclosure.

It is understood that the disclosure is not limited to the particular methodology, protocols, etc., described herein, as these may vary as the skilled artisan will recognize. It is also to be understood that the terminology used herein is used for the purpose of describing particular embodiments only, and is not intended to limit the scope of the disclosure. It also is to be noted that, as used herein and in the appended embodiments, the singular forms "a," "an," and "the" include the plural reference unless the context clearly dictates otherwise. Thus, for example, a reference to "a structure" is a reference to one or more structures and equivalents thereof known to those skilled in the art.

Unless defined otherwise, all technical and scientific terms used herein have the same meanings as commonly understood by one of ordinary skill in the art. The embodiments of the disclosure and the various features and advantageous details thereof are explained more fully with reference to the non-limiting embodiments and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein.

Any numerical values recited herein include all values from the lower value to the upper value in increments of one unit provided that there is a separation of at least two units between any lower value and any higher value. As an example, if it is stated that the concentration of a component or value of a process variable such as, for example, size and the like, is, for example, from 1 to 90, specifically from 20 to 80, more specifically from 30 to 70, it is intended that values such as 15 to 85, 22 to 68, 43 to 51, 30 to 32, etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Embodiments

1. A shooting stall comprising:

a first wall comprising an upstream end, a downstream end, and a side surface that extends between the upstream end and the downstream end;

a second wall disposed substantially parallel to the first wall, the second wall comprising an upstream end, a downstream end, and a side surface facing the first wall that extends between the upstream end and the downstream end; and an axis extending through the first wall and the second wall, wherein the axis is positioned between the upstream end and the downstream end of each of the first wall and second wall, and wherein the side surface of the second wall comprises a first portion that extends from the axis and slopes away from the first wall.

2. The shooting stall of embodiment 1, wherein the first portion of the side surface of the second wall extends from the axis toward the downstream end of the second wall.

3. The shooting stall of embodiment 1, wherein the first portion of the side surface of the second wall is disposed at an angle in a range of 98 degrees to 116 degrees.

4. The shooting stall of embodiment 1, wherein the first portion of the side surface of the second wall curves away from the first wall.

5. The shooting stall of embodiment 4, wherein the first portion of the side surface of the second wall comprises a concave curve.

6. The shooting stall of embodiment 1, wherein the first portion of the side surface of the second wall extends from the axis toward the upstream end of the second wall.

7. The shooting stall of embodiment 1, wherein the side surface of the second wall comprises a second portion that extends from the axis in a direction opposite the first portion and that slopes away from the first wall.

8. The shooting stall of embodiment 1, wherein the side surface of the first wall includes a first portion that extends from the axis and slopes away from the second wall.

9. The shooting stall of embodiment 1, wherein a first edge of the first portion of the side surface of the second wall is adjustable between first and second lateral positions, and wherein the first lateral position is closer to the first wall than the second lateral position.

10. The shooting stall of embodiment 9, wherein the first portion of the side surface of the second wall is disposed at a first angle to the axis when the first edge is in the first lateral position and the first portion of the side surface of the second wall is disposed at a second angle to the axis when the first edge is in the second lateral position.

11. The shooting stall of embodiment 1, further comprising a ceiling disposed over the first wall and the second wall, wherein a first portion of the ceiling is sloped downward from the upstream end of the first wall and the upstream end of the second wall to the axis, and wherein a second portion of the ceiling is sloped upward from the axis to the downstream end of the first wall and the downstream end of the second wall.

12. The shooting stall of embodiment 1 further comprising:

a first door coupled to the side surface of the first wall, wherein the first door is configured to orient substantially parallel to the axis, and a second door coupled to the side surface of the second wall, wherein the second door is configured to orient substantially parallel to the axis.

13. A shooting stall comprising:

a first wall comprising an upstream end, a downstream end, and a side surface that extends between the upstream end and the downstream end;

a second wall disposed substantially parallel to the first wall, the second wall comprising an upstream end, a downstream end, and a side surface facing the first wall that extends between the upstream end and the downstream end; and an axis extending through the first wall and the second wall, wherein the axis is positioned between the upstream end and the downstream end of each of the first wall and second wall, wherein the side surface of the first wall comprises:

a first portion that extends from the axis toward the downstream end of the first wall and that slopes away from the second wall, and a second portion that extends from the axis toward the upstream end of the first wall and that slopes away from the second wall, and wherein the side surface of the second wall comprises:

a first portion that extends from the axis toward the downstream end of the second wall and that slopes away from the first wall, and a second portion that extends from the axis toward the upstream end of the second wall and that slopes away from the first wall.

14. The shooting stall of embodiment 13, wherein the first portion of the side surface of the first wall is disposed at an angle in a range of 101 degrees to 108 degrees.

15. The shooting stall of embodiment 13, wherein the first portion of the side surface of the second wall is disposed at an angle in a range of 101 degrees to 108 degrees.

16. A shooting range comprising:

a plurality of walls that are substantially parallel and an axis that passes through the plurality of walls, each of the plurality of walls comprising an upstream end, a downstream end, a first side surface extending from the upstream end to the downstream end, and a second side surface extending from the upstream end to the downstream end, wherein the plurality of walls defines a plurality of shooting stalls, and wherein at least one shooting stall of the plurality of shooting stalls comprises: a respective first side surface of one of the plurality of walls and an opposing respective second side surface of another of the plurality of walls, wherein the opposing respective second side surface comprises a first portion extending from the axis and sloping away from the respective first side surface; and an air handling system, wherein a parameter of the shooting range is selected based at least in part on the first portion of the opposing respective second side surface.

17. The shooting range of embodiment 16, wherein the parameter of the shooting range comprises air volume supplied to the air handling system.

18. The shooting range of embodiment 16, wherein the parameter of the shooting range comprises air speed at the axis.

19. The shooting range of embodiment 16, wherein the first portion of the opposing respective second side surface is disposed at an angle in a range of 98 degrees to 116 degrees.

20. The shooting range of embodiment 16, wherein the first portion of the opposing respective second side surface curves away from the first wall.

The invention claimed is:

1. A shooting stall comprising:

a first wall comprising an upstream end, a downstream end, and a side surface that extends between the upstream end and the downstream end;

a second wall disposed substantially parallel to the first wall, the second wall comprising an upstream end, a downstream end, and a side surface facing the first wall that extends between the upstream end and the downstream end; and an axis extending through the first wall and the second wall, wherein the axis is positioned between the upstream end and the downstream end of each of the first wall and second wall, and wherein the side surface of the second wall comprises a first portion that extends from the axis toward the downstream end of the second wall and that curves away from the first wall.

2. The shooting stall of claim 1, wherein the first portion of the side surface of the second wall extends from the axis toward the downstream end of the second wall.

3. The shooting stall of claim 1, wherein the first portion of the side surface of the second wall comprises a concave curve.

4. The shooting stall of claim 1, wherein the first portion of the side surface of the second wall extends from the axis toward the upstream end of the second wall.

5. The shooting stall of claim 1, wherein the side surface of the first wall includes a first portion that extends from the axis and curves away from the second wall.

6. The shooting stall of claim 5, wherein the first portion of the side surface of the first wall comprises a concave curve.

7. The shooting stall of claim 1, wherein a first edge of the first portion of the side surface of the second wall is adjustable between first and second lateral positions, and wherein the first lateral position is closer to the first wall than the second lateral position.

8. The shooting stall of claim 7, wherein the first portion of the side surface of the second wall is disposed at a first angle to the axis when the first edge is in the first lateral position and the first portion of the side surface of the second wall is disposed at a second angle to the axis when the first edge is in the second lateral position.

9. A shooting stall comprising:

a first wall comprising an upstream end, a downstream end, and a side surface that extends between the upstream end and the downstream end;

a second wall disposed substantially parallel to the first wall, the second wall comprising an upstream end, a downstream end, and a side surface facing the first wall that extends between the upstream end and the downstream end; and an axis extending through the first wall and the second wall, wherein the axis is positioned between the upstream end and the downstream end of each of the first wall and second wall, wherein the side surface of the first wall comprises:

a first portion that extends from the axis toward the downstream end of the first wall and that curves away from the second wall, and a second portion that extends from the axis toward the upstream end of the first wall and that curves away from the second wall, and wherein the side surface of the second wall comprises:

a first portion that extends from the axis toward the downstream end of the second wall and that curves away from the first wall, and a second portion that extends from the axis toward the upstream end of the second wall and that curves away from the first wall.

10. The shooting stall of claim 9, wherein the first portion of the side surface of the first wall comprises a concave curve.

11. The shooting stall of claim 9, wherein the second portion of the side surface of the first wall comprises a concave curve.

12. The shooting stall of claim 9, wherein the first portion of the side surface of the second wall comprises a concave curve.

13. The shooting stall of claim 9, wherein a first edge of the first portion of the side surface of the second wall is adjustable between first and second lateral positions, and wherein the first lateral position is closer to the first wall than the second lateral position.

14. The shooting stall of claim 13, wherein the first portion of the side surface of the second wall is disposed at a first angle to the axis when the first edge is in the first lateral position and the first portion of the side surface of the second wall is disposed at a second angle to the axis when the first edge is in the second lateral position.

15. The shooting range of claim 9, wherein the first wall has an elliptical shape, and wherein the second wall has an elliptical shape.

16. A shooting range comprising:

a plurality of walls that are substantially parallel and an axis that passes through the plurality of walls, each of the plurality of walls comprising an upstream end, a downstream end, a first side surface extending from the upstream end to the downstream end, and a second side surface extending from the upstream end to the downstream end, wherein the plurality of walls defines a plurality of shooting stalls, and wherein at least one shooting stall of the plurality of shooting stalls comprises: a respective first side surface of one of the plurality of walls and an opposing respective second side surface of another of the plurality of walls, wherein the opposing respective second side surface comprises a first portion extending from the axis toward the respective downstream end and curving away from the respective first side surface; and an air handling system, wherein a parameter of the shooting range is based at least in part on the first portion of the opposing respective second side surface.

17. The shooting range of claim 16, wherein the parameter of the shooting range comprises air volume supplied to the air handling system.

18. The shooting range of claim 16, wherein the parameter of the shooting range comprises air speed at the axis.

19. The shooting range of claim 16, wherein a first edge of the first portion of the opposing respective second side surface is adjustable between first and second lateral positions, and wherein the first lateral position is closer to the respective first side surface than the second lateral position.

20. The shooting range of claim 19, wherein the first portion of the opposing respective second side surface is disposed at a first angle to the axis when the first edge is in the first lateral position and the first portion of the side surface of the second wall is disposed at a second angle to the axis when the first edge is in the second lateral position.

21. A shooting range comprising:

a plurality of walls that are substantially parallel, wherein the plurality of walls defines a plurality of shooting stalls, each shooting stall comprising an upstream end and a downstream end; and an air handling system configured to move air through each shooting stall from a respective upstream end to a respective downstream end, wherein at least one shooting stall of the plurality shooting stalls is a closeable shooting stall and comprises:

a respective first side surface of one of the plurality of walls and an opposing respective second side surface of another of the plurality of walls, and a first door coupled to the respective first side surface, wherein the first door is configured to move between a first position in which the closeable shooting stall is in an open state to a second position in which the first door extends toward the respective second side surface and the closeable shooting stall is in a closed state, and wherein the first door is configured to inhibit air flow, generated by the air handling system, from flowing through the closeable shooting stall when the first door is in the second position and the closeable shooting stall is in a closed state.

22. The shooting range of claim 21, wherein the closeable shooting stall further comprises a second door coupled to the respective second side surface, wherein the second door is configured to move between a first position in which the closeable shooting stall is in the open state and a second position in which the second door extends toward the respective first side surface and the closeable shooting stall is in the closed state.

* * * * *